US010895154B2

(12) United States Patent
Zhang et al.

(10) Patent No.: US 10,895,154 B2
(45) Date of Patent: Jan. 19, 2021

(54) BASE MECHANISM OF SINGLE PROP CAPABLE OF BEING UNLOADED AT REDUCED PRESSURE

(71) Applicant: China University of Mining and Technology, Jiangsu (CN)

(72) Inventors: Qiang Zhang, Jiangsu (CN); Jixiong Zhang, Jiangsu (CN); Zhongya Wu, Jiangsu (CN); Wenyue Qi, Jiangsu (CN); Hong Yan, Jiangsu (CN); Meng Li, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 253 days.

(21) Appl. No.: 16/088,437

(22) PCT Filed: Nov. 2, 2017

(86) PCT No.: PCT/CN2017/000660
§ 371 (c)(1),
(2) Date: Sep. 25, 2018

(87) PCT Pub. No.: WO2018/082202
PCT Pub. Date: May 11, 2018

(65) Prior Publication Data

US 2020/0300088 A1 Sep. 24, 2020

(30) Foreign Application Priority Data

Nov. 3, 2016 (CN) ..... 2016 1 0957620

(51) Int. Cl.
*E21D 15/60* (2006.01)
*E21D 15/55* (2006.01)
(Continued)

(52) U.S. Cl.
CPC ..... *E21D 15/60* (2013.01); *A47B 91/00* (2013.01); *E21D 15/20* (2013.01); *E21D 15/55* (2013.01)

(58) Field of Classification Search
CPC ..... E21D 15/60; E21D 15/44; E21D 15/55; E21D 15/20; A47B 91/005; A47B 23/001;
(Continued)

(56) References Cited

U.S. PATENT DOCUMENTS 1,596,657 A * 8/1926 Heber ..... E04H 12/2292 52/168
3,148,851 A * 9/1964 Condon ..... A45B 11/00 248/515

(Continued)

FOREIGN PATENT DOCUMENTS

CN 2769520 4/2006
CN 104879145 9/2015

(Continued)

OTHER PUBLICATIONS

"International Search Report (Form PCT/ISA/210)", dated Feb. 5, 2018, with English translation thereof, pp. 1-4.

*Primary Examiner* — Nkeisha Smith
(74) *Attorney, Agent, or Firm* — JCIPRNET

(57) ABSTRACT

Provided is a base mechanism of a single prop capable of being unloaded at reduced pressure, including a base bottom plate and two wedge-shaped support blocks, where one of the wedge-shaped support blocks serves as a fixed wedge-shaped support block and is welded onto the base bottom plate, and the other of the wedge-shaped support blocks serves as a movable wedge-shaped support block and is connected to the fixed wedge-shaped support block by using a screw rod and a nut. The present invention can effectively unload the single prop at reduced pressure or remove the single prop in a contracted manner, is of a simple structure,
(Continued)

is convenient to operate, has a good use effect, overcomes the technical problem that it is difficult to unload a single prop at reduced pressure in this technical feature, and is widely applicable in this technical field.

2 Claims, 1 Drawing Sheet

(51) Int. Cl.
*E21D 15/20* (2006.01)
*A47B 91/00* (2006.01)

(58) Field of Classification Search
CPC ..... A47B 23/002; A45B 2023/0012; Y10S 248/91; E04H 12/2246; A63B 2071/026; F16L 3/24; F16L 3/243; F16L 3/2431; F16L 3/245
USPC ..... 248/357, 507, 508, 346.03, 910, 346.2, 248/346.01, 346.5, 678, 680, 500
See application file for complete search history.

(56) References Cited

U.S. PATENT DOCUMENTS 3,212,415 A * 10/1965 Byrd ..... E01F 9/629 404/10
4,269,534 A * 5/1981 Ryan ..... E01F 9/681 256/1
4,488,696 A * 12/1984 Sauber ..... H02G 3/22 248/65
4,515,195 A * 5/1985 Gladstein ..... B27L 7/00 144/195.6
4,609,175 A * 9/1986 Conover ..... A45B 11/00 135/16
5,039,043 A * 8/1991 Hodge ..... B01L 9/00 248/125.8
5,172,885 A * 12/1992 Kreischer ..... A45B 11/00 248/215
5,181,695 A * 1/1993 Arthur ..... E01F 7/06 256/13.1
5,197,819 A * 3/1993 Hughes ..... E01F 9/681 116/63 R
5,902,067 A * 5/1999 Rushing ..... E01F 7/06 256/13.1
6,240,689 B1 * 6/2001 Haddad ..... E04H 12/2261 248/49
6,257,557 B1 * 7/2001 Anderson ..... E01F 15/0469 256/1
6,527,255 B2 * 3/2003 O'Berry ..... E04H 17/063 256/1
6,592,093 B2 * 7/2003 Valentz ..... F16L 3/00 248/346.01
7,357,366 B1 * 4/2008 White ..... A63B 71/023 248/156
7,874,122 B2 * 1/2011 Calle ..... E02D 29/0233 52/741.3
7,942,612 B1 * 5/2011 Willison ..... E02D 5/74 405/244
9,255,356 B2 * 2/2016 Cheon ..... D06F 39/125
9,404,230 B2 * 8/2016 Habodasz ..... E04C 3/30
9,555,381 B2 * 1/2017 Evans ..... F16M 11/22
10,344,496 B1 * 7/2019 Cefalo ..... E04H 12/2269
2010/0288905 A1 * 11/2010 Shaffstall ..... B62J 11/00 248/540
2011/0084581 A1 * 4/2011 Cheon ..... A47B 91/024 312/228
2018/0277285 A1 * 9/2018 Stilwell ..... H01B 17/14

FOREIGN PATENT DOCUMENTS

CN 104929663 9/2015
CN 106285739 1/2017
CN 106499421 3/2017
CN 206280088 6/2017
GB 608054 9/1948

* cited by examiner

BASE MECHANISM OF SINGLE PROP CAPABLE OF BEING UNLOADED AT REDUCED PRESSURE

CROSS-REFERENCE TO RELATED APPLICATION

This application is a 371 of international application of PCT application serial no. PCT/CN2017/000660, filed on Nov. 2, 2017, which claims the priority benefit of China application no. 201610957620.3, filed on Nov. 3, 2016. The entirety of each of the abovementioned patent applications is hereby incorporated by reference herein and made a part of this specification.

BACKGROUND

Technical Field

The present invention relates to the field of base mechanism technologies, and in particular, to a base mechanism of a single prop capable of being unloaded at reduced pressure.

Description of Related Art

In coal mining, a stope is usually shored by a single hydraulic prop. However, for existing single props used for coal mine shoring, there is always a general problem that it is difficult to unload a single hydraulic prop at reduced pressure, which greatly reduces working efficiency.

SUMMARY

An objective of the present invention is to provide a base mechanism of a single prop capable of being unloaded at reduced pressure, so as to resolve the foregoing problem existing in the prior art and facilitate unloading a single prop at reduced pressure.

To achieve the aforementioned objective, the present invention provides the following solution: The present invention provides a base mechanism of a single prop capable of being unloaded at reduced pressure, including a base bottom plate and two wedge-shaped support blocks, where one of the wedge-shaped support blocks serves as a fixed wedge-shaped support block and is welded onto the base bottom plate, and the other of the wedge-shaped support blocks serves as a movable wedge-shaped support block and is connected to the fixed wedge-shaped support block by using a screw rod and a nut.

Preferably, two ends of each of the fixed wedge-shaped support block and the movable wedge-shaped support block each are provided with a lug, heights of the lugs on the two ends of the fixed wedge-shaped support block are different from heights of the lugs on the two ends of the movable wedge-shaped support block, the fixed wedge-shaped support block and the movable wedge-shaped support block are symmetrically disposed, and the two ends of the fixed wedge-shaped support block and the two ends of the movable wedge-shaped support block overlap with each other at the lugs and are connected by using screw rods and nuts at the lugs.

Preferably, upper end faces of the wedge-shaped support blocks are semi-conical faces, a side of each of the semi-conical faces proximal to the other wedge-shaped support block is provided with a semicircular notch, the fixed wedge-shaped support block and the movable wedge-shaped support block are symmetrically disposed and connected together to form an assembly, a center of the assembly is a cylindrical hole, and an upper end face of the assembly is a conical face.

The base mechanism of a single prop capable of being unloaded at reduced pressure of the present invention, compared with the prior art, obtains the following beneficial effects.

In the base mechanism of a single prop capable of being unloaded at reduced pressure of the present invention, a bevel structure on the top of a wedge-shaped support block is used, and by means of sliding of the movable wedge-shaped support block, a height of a face of the base in contact with the single prop is lowered, so as to implement unloading at reduced pressure; the single prop can be effectively unloaded at reduced pressure or removed in a contracted manner; the base mechanism is of a simple structure, is convenient to operate, has a good use effect, overcomes the technical problem that it is difficult to unload a single prop at reduced pressure in this technical field, and is widely applicable in this technical field.

BRIEF DESCRIPTION OF THE DRAWINGS

To illustrate the technical solutions of the embodiments of the present invention or in the prior art more clearly, the accompanying drawings required for describing the embodiments or the prior art are briefly introduced below. Apparently, the accompanying drawings in the following description are merely some embodiments of the present invention, and a person of ordinary skill in the art can still derive other accompanying drawings from the accompanying drawings without creative efforts.

Figure 1:
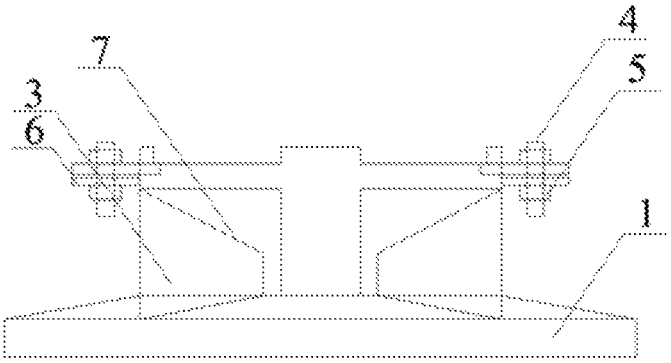
FIG. 1 is a schematic structural diagram of a base mechanism of a single prop capable of being unloaded at reduced pressure according to the present invention from a perspective.

wherein, 1: Base bottom plate; 2: Fixed wedge-shaped support block; 3: Movable wedge-shaped support block; 4: Screw rod; 5: Nut; 6: Lug; 7: Conical face; 8: Cylindrical hole.

DETAILED DESCRIPTION

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

An objective of the present invention is to provide a base mechanism of a single prop capable of being unloaded at reduced pressure, so as to resolve the problem existing in the prior art and facilitate unloading a single prop at reduced pressure.

To make the objectives, technical solutions, and advantages of the present invention more comprehensible, the present invention is described below in further detail with reference to the accompanying drawings and specific implementations.

Embodiment 1

This embodiment provides a base mechanism of a single prop capable of being unloaded at reduced pressure, including a base bottom plate 1, a fixed wedge-shaped support block 2, and a movable wedge-shaped support block 3. Two ends of each of the fixed wedge-shaped support block 2 and the movable wedge-shaped support block 3 each are provided with a lug 6, heights of the lugs 6 on the two ends of the fixed wedge-shaped support block 2 are different from heights of the lugs 6 on the two ends of the movable wedge-shaped support block 3, the fixed wedge-shaped support block 2 and the movable wedge-shaped support block 3 are symmetrically disposed, and the two ends of the fixed wedge-shaped support block 2 and the two ends of the movable wedge-shaped support block 3 overlap with each other at the lugs 6 and are connected by using screw rods 4 and nuts 5 at the lugs 6.

An upper end face of the fixed wedge-shaped support block 2 and an upper end face of the movable wedge-shaped support block 3 are semi-conical faces, the fixed wedge-shaped support block 2 and the movable wedge-shaped support block 3 are symmetrically disposed and connected together by using bolts and nuts 5 to form an assembly, and an upper end face of the assembly is a conical face 7.

Embodiment 2

In this embodiment, improvements are made based on Embodiment 1, and this embodiment includes all the content of Embodiment 1. To be specific, in this embodiment, the base mechanism of a single prop capable of being unloaded at reduced pressure includes all structural features of the base mechanism of a single prop capable of being unloaded at reduced pressure in Embodiment 1. Specific improvements are as follows.

Figure 2:
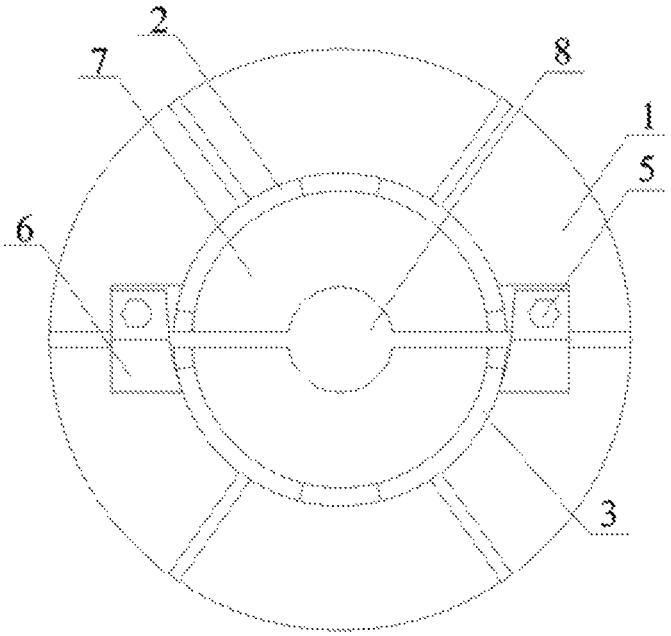
FIG. 2 is a schematic structural diagram of a base mechanism of a single prop capable of being unloaded at reduced pressure according to the present invention from another perspective.

As shown in FIG. 1 and FIG. 2, in the base mechanism of a single prop capable of being unloaded at reduced pressure of this embodiment, a side of each of the semi-conical faces proximal to the other wedge-shaped support block of the fixed wedge-shaped support block 2 and the movable wedge-shaped support block 3 is provided with a semicircular notch, the fixed wedge-shaped support block 2 and the movable wedge-shaped support block 3 are symmetrically disposed and connected together by using bolts and nuts 5 to form an assembly, a cylindrical hole 8 is formed at a center of the assembly, and an upper end face of the assembly is a conical face. Existence of the semicircular notches, on the one hand, can facilitate machining and manufacturing of the fixed wedge-shaped support block 2 and the wedge-shaped support block 3 whose upper end faces are semi-conical faces, and on the other hand, can reduce usage of raw materials, to lower costs.

Working Principle:

The conical face 7 of the base mechanism of a single prop capable of being unloaded at reduced pressure of the present invention is in contact with the single prop. When it is needed to unload the single prop at reduced pressure or remove the single prop in a contracted manner, the movable wedge-shaped support block 3 is enabled, by removing the screw rods 4 and nuts 5 to slide outward, and the semi-conical face on the top of the movable wedge-shaped support block 3 generates a height difference Δh, so that the height of the face of the base in contact with the single prop is lowered, thereby achieving unloading at reduced pressure.

Specific examples are used in the present invention to describe the principle and implementations of the present invention. The descriptions of the foregoing embodiments are merely intended to help understand the method and core idea of the present invention. In addition, with regard to the specific implementations and the application scope, modifications may be made by a person of ordinary skill in the art according to the idea of the present invention. Therefore, content of this specification shall not be construed as a limitation on the present invention.

What is claimed is:

1. A base mechanism of a single prop capable of being unloaded at reduced pressure, comprising a base bottom plate and two wedge-shaped support blocks, wherein one of the wedge-shaped support blocks serves as a fixed wedge-shaped support block and is welded onto the base bottom plate, the other one of the wedge-shaped support blocks serves as a movable wedge-shaped support block and is connected to the fixed wedge-shaped support block by a screw rod and a nut, two ends of each of the fixed wedge-shaped support block and the movable wedge-shaped support block each are provided with a lug, heights of the lugs on the two ends of the fixed wedge-shaped support block are different from heights of the lugs on the two ends of the movable wedge-shaped support block, the fixed wedge-shaped support block and the movable wedge-shaped support block are symmetrically disposed, and the two ends of the fixed wedge-shaped support block and the two ends of the movable wedge-shaped support block overlap with each other at the lugs and are connected by screw rods and nuts at the lugs.

2. The base mechanism of a single prop capable of being unloaded at reduced pressure according to claim 1, wherein upper end faces of the wedge-shaped support blocks are semi-conical faces, a side of each of the semi-conical faces proximal to the movable wedge-shaped support block is provided with a semicircular notch, the fixed wedge-shaped support block and the movable wedge-shaped support block are symmetrically disposed and connected together to form an assembly, a center of the assembly is a cylindrical hole, and an upper end face of the assembly is a conical face.

* * * * *